US006929444B1

(12) United States Patent
Bomski

(10) Patent No.: US 6,929,444 B1
(45) Date of Patent: Aug. 16, 2005

(54) ROTARY ENGINE DEVICE AND POWER GENERATING SYSTEM

(76) Inventor: Gerald F. Bomski, 3350 Phillips Rd., Green Bay, WI (US) 54311

( * ) Notice: Subject to any disclaimer, the term of this patent is extended or adjusted under 35 U.S.C. 154(b) by 0 days.

(21) Appl. No.: 10/691,086

(22) Filed: Oct. 23, 2003

(51) Int. Cl.[7] ..... F01D 1/18
(52) U.S. Cl. ..... 415/80
(58) Field of Search ..... 415/80, 108, 114, 415/115, 169.1, 169.2

(56) References Cited

U.S. PATENT DOCUMENTS

| | | | | | |
|---|---|---|---|---|---|
| 658,556 | A | | 9/1900 | Pitt | |
| 768,884 | A | * | 8/1904 | O'Brien | 415/80 |
| 890,392 | A | * | 6/1908 | Adams | 415/80 |
| 1,319,323 | A | * | 10/1919 | Carroll | 415/61 |
| 1,367,801 | A | | 2/1921 | Clark | |
| 2,507,151 | A | | 5/1950 | Gabriel | |
| 4,021,165 | A | | 5/1977 | Rylewski | |
| 4,061,449 | A | | 12/1977 | Rylewski | |
| 4,090,825 | A | | 5/1978 | Rylewski | |
| 4,184,813 | A | | 1/1980 | Rylewski | |
| 4,187,064 | A | | 2/1980 | Wheeler | |
| 4,274,814 | A | | 6/1981 | Rylewski | |
| 4,462,774 | A | | 7/1984 | Hotine et al. | |
| 5,474,043 | A | | 12/1995 | Mallen | |

* cited by examiner

*Primary Examiner*—Ninh H. Nguyen

(74) *Attorney, Agent, or Firm*—Tipton L. Randall

(57) ABSTRACT

A rotary expansible chamber device includes a sealable shell member with a hollow interior and a cylindrical stator member, with stepped interior surface, rigidly secured interior the shell member. A cylindrical rotor member is positioned concentrically interior the cylindrical stator member, forming a plurality of chambers with the stator member's continuously stepped, interior surface. The rotor member is supported by a central shaft member rotatably secured to the shell member. The rotor member includes a plurality of radial channels with outlets at the rotor member's periphery, adjacent the stator member's stepped interior surface. The radial channels are in fluid communication with a channel interior the central shaft member. A planar collar member is fastened to each side of the rotor member. The collar members essentially covert he cylindrical stator member circumferential to the rotor member. The collar members include a plurality of apertures offset from the radial channel outlets of the rotor member. A pressurized working fluid, flowing into the central shaft member's channel and through the rotor member's radial channels to the channel outlets, impinges on the stator member's stepped surface, thereby imparting rotational movement to the rotor member and attached central shaft. The spent working fluid vents from between the stator member and rotor member, via the offset apertures in the collar members, and is contained within the shell member.

20 Claims, 17 Drawing Sheets

ROTARY ENGINE DEVICE AND POWER GENERATING SYSTEM

CROSS-REFERENCE TO RELATED APPLICATIONS, IF ANY

None.

STATEMENT REGARDING FEDERALLY SPONSORED RESEARCH OR DEVELOPMENT

Not applicable.

REFERENCE TO A MICROFICHE APPENDIX IF ANY

Not applicable.

BACKGROUND OF THE INVENTION

1. Field of the Invention

The present invention relates to a rotary engine. More particularly, the present invention relates to a rotary expansible chamber engine. Most particularly, the present invention relates to a rotary expansible chamber engine integrated into a power generating system.

2. Background Information

Many devices are known that convert potential energy into mechanical energy that can be put to various useful ends. Electrical power is generated by the passage of water through turbines to convert the potential energy of the water to mechanical energy which rotates the turbines, thereby producing electrical power. Gas turbines that convert the potential energy of a compressed gas into mechanical energy are also known. These devices are termed expansible chamber engines.

Some examples of inventions involving expansible chamber devices for which patents have been granted include the following.

Pitt, in U.S. Pat. No. 658,556, describes an early rotary engine or motor that includes an engine body or cylinder with heads bolted to the faces of the cylinder. A shaft is mounted rotatably in the cylinder with an eccentric keyed to the shaft. On the eccentric is mounded a triangular body or piston. The triangular piston turns within a square chamber, with a working fluid entering the square chamber at each corner thereof, to rotate the cylinder and connected shaft. Thus, a rotary engine was known as early as 1900.

U.S. Pat. No. 1,367,801 by Clark describes a rotary engine where steam is admitted from a source to the conduit from which it passes into the bonnet, through perforations of the valve, leaving the valve by the ports. The valve is rotated so the ports match with the ports of the annular ring on the runner. The steam then passes through the ports into an annular channel, expanding in one direction against the vanes and in the other direction against the two disks positioned in the annular channel. The disks rotate on an axis transversely of the radius of the runner, and the pressure pushes against the spirally disposed vanes causing a rotation of the runner in the direction of the arrow D. When the rotation has proceeded to a point equal to half of a revolution, the vanes leave the disks, and the steam which causes the movement of the runner then passes out of the channel through the ports and into another channel, filling the space between the vanes and the two disks positioned within that channel. This rotates the runner again in the direction of the arrow D. This process is repeated to drive the rotary engine in one direction.

In U.S. Pat. No. 2,507,151, Gabriel discloses a rotary hydraulic motor that includes a cylinder with a rotor in the cylinder having inner and outer annular recesses in opposite ends thereof. One of the inner recesses constitutes a pressure-receiving recess, and the other constitutes an exhaust-receiving recess. The end heads on the cylinder enclose the rotor, one of the heads having an annular pressure manifold and the other annular exhaust manifold opening into the pressure-receiving and exhaust-receiving recesses, respectively. The rotor has a pressure port connecting the pressure-receiving recess with one portion and an exhaust port connecting the exhaust-receiving recess with another portion of the periphery of the rotor. A passage connects the pressure port with the outer annular recess on the end of the rotor, including the exhaust-receiving recess, and another passage connects the exhaust port with the outer annular recess on the end of the rotor, including the pressure-receiving recess.

Rylewski, in a series of U.S. Patents, including U.S. Pat. Nos. 4,021,165; 4,061,449; 4,090,825; 4,184,813; and 4,274,814, describes a rotative machine for fluids comprising a plate with spiral-like passages (stator), facing a disc (rotor) mounted for rotation relative to the stator on a common axis and carrying, on its face in front of the passages, vane wheels mounted for rotation on axes transverse to the common axis whose vanes circulate in the passages where they form fluid compartments completed by the cooperating surfaces of the stator and of the rotor covering the passages. In one embodiment, a rotor faces the first and second stators, respectively, and has vane wheels cooperating, by their diametrically opposite parts, simultaneously with the passages of the first and second stators between an inlet chamber and an outlet chamber. The fluid entering the machine is thus directed toward one and the other inlet chambers and the outlet chambers of the two stators are connected to a common outlet of the machine.

U.S. Pat. No. 4,187,064 by Wheeler describes a rotary machine that includes an outer housing, and a cam-shaped rotor mounted within the housing for rotation about an axis coincident with the axis of the housing with two sealing members forth rotor equally supported at diametrically opposed positions within the housing for movement toward and away from the peripheral surface of the rotor and in at least close sealing proximity with the adjacent surface of the rotor during at least part of the rotation of the rotor. The lobe portion of the rotor is at least in close sealing proximity with an adjacent inner surface of the housing. An inlet passage through the rotor opens through the surface thereof on one side of the lobe portion. An exit passage also passes through the rotor and opens through the surface thereof on the other side of the lobe portion. The inlet and exit passages communicate with ports for admitting working fluid to, and exhausting working fluid from, the rotor. Also disclosed is a twin rotor arrangement in which two rotors are supported within the housing on a common support shaft and separated by a partition wall with the respective lobe portions and sealing members being at diametrically opposed positions within the housing to dynamically balance the forces within the machine.

In U.S. Pat. No. 4,462,774, Hotine et al. disclose a rotary expander device that combines a square working chamber with a three lobed, sext-arcuate, rotary working member which defines four expansible and contractible spandrel chambers in the corners of the square, as the three lobed rotor revolves and its external surfaces make wiping contact with the interior surfaces of the square working chamber. Fluid flow from exterior intake and exhaust ports to four ports in the spandrel corners is controlled by a rotary valve coupled to the drive shaft, which is coupled to the center of the rotor. The ports and valving provide sequential, spandrel chamber expansion and contraction with intake and exhaust of fluid as the sext-arcuate rotor revolves with its center describing a retrograde circular orbit around the center of the square chamber. The device may serve as either a motor when fluidly driven or a pump when shaft driven.

Mallen, in U.S. Pat. No. 5,474,043, discloses an internal combustion engine having a ring-shaped stator with a plurality of thin slits. A rotor, having a plurality of helicotoroidal troughs formed on its inner surface, encloses the stator. A planar vane wheel, having a plurality of radially extending vanes, is resident in each of the thin slits, with the vanes communicating with the respective helicotoroidal troughs. Rotation of the rotor imparts rotation to the vane wheels. The interaction of the stator, troughs, and vanes produces a plurality of sequential intake, compression, combustion, expansion, and exhaust chambers.

While the invention is amenable to various modifications and alternative forms, specifics thereof have been shown by way of example in the drawings and will be described in detail. It should be understood, however, that the intention is not necessarily to limit the invention to the particular embodiments described. On the contrary, the intention is to cover all modifications, equivalents, and alternatives falling within the spirit and scope of the invention, as defined by the appended claims.

SUMMARY OF THE INVENTION

The invention is directed to a rotary expansible chamber device. The device includes a sealable shell member with hollow interior, and a cylindrical stator member of a selected length rigidly secured interior the shell member, the stator member having a continuously stepped, interior surface. A cylindrical rotor member of said selected length is positioned concentrically interior the cylindrical stator member forming a plurality of chambers with the stator member's continuously stepped, interior surface. The rotor member is fastened to and supported by a central shaft member rotatably secured to the shell member. The rotor member includes a plurality of radial channels with outlets at the rotor member's periphery adjacent the stator member's stepped, interior surface. The radial channels are in fluid communication with a channel interior the central shaft member. A pair of planar collar members is present, with each collar member fastened to one side of the rotor member. The collar members essentially cover the cylindrical stator member circumferential to the rotor member. The collar members include a plurality of apertures offset from the radial channel outlets of the rotor member. A pair of spacer members is present, with each spacer member sealingly secured between a collar member and the rotor member, the spacer members providing a selected clearance between the collar members and the cylindrical stator member. In operation, a pressurized working fluid, flowing into the central shaft member's channel and through the rotor member's radial channels to the channel outlets, impinges on the stator member's stepped surface, thereby imparting rotational movement to the rotor member and attached central shaft. The spent working fluid vents from between the stator member and rotor member via the offset apertures in the collar members and is contained within the shell member.

DESCRIPTION OF THE EMBODIMENTS

Nomenclature

Figure 1:
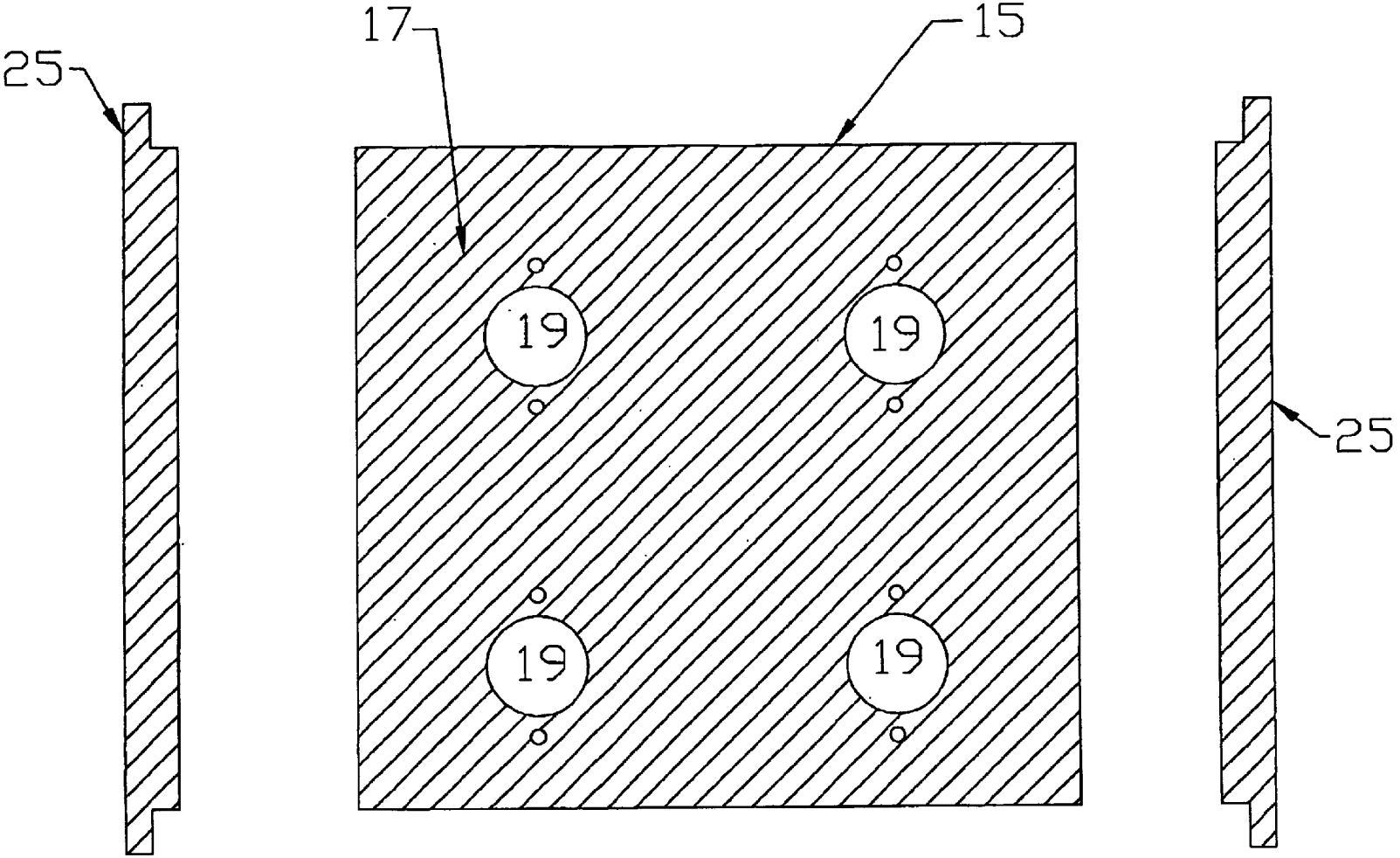
FIG. 1 is a side view of the sealable shell member of the present invention.

10 Rotary Expansible Chamber Device
15 Shell Member
17 Main Body Portion
19 Outlet Apertures of Shell Member
20 Base Support of Shell Member
25 End Caps of Shell Member
30 Aperture of End Cap
40 Stator Member
42 Dimpled Side Surface of Stator Member
45 Stepped Interior Surface of Stator Member
47 Radial Sections of Interior Surface
48 Non-Radial Sections of Interior Surface
49 Blunt Edge of Stepped Interior Surface
60 Rotor Member
62 Chambers Between Stator and Rotor
63 Cylindrical Outer Surface of Rotor Member
65 Central Shaft Member
67 Channel in Central Shaft
70 Radial Channels of Rotor Member
71 Spiral Ridges of Radial Channel
72 Outlet of Radial Channel
74 Nozzle in Outlet of Radial Channel

75 Periphery Section of Rotor Member
77 Fastening Apertures in Rotor Member
78 Pressure Guides within Central Shaft Member
80 Collar Members
82 Fastening Apertures in Collar Members
84 Exhaust Apertures in Collar Members
86 Dimpled Surface of Collar Member
90 Spacer Members
92 Fasting Apertures in Spacer Members
95 Bearings for Central Shalt Member
97 Outlet Conduit Construction The invention is directed to a rotary expansible chamber device. The device includes a sealable shell member with hollow interior, and a cylindrical stator member of a selected length rigidly secured interior the shell member, the stator member having a continuously stepped, interior surface. A cylindrical rotor member of said selected length is positioned concentrically interior the cylindrical stator member forming a plurality of chambers with the stator member's continuously stepped, interior surface. The rotor member is fastened to and supported by a central shaft member rotatably secured to the shell member. The rotor member includes a plurality of radial channels with outlets at the rotor member's periphery adjacent the stator member's stepped, interior surface. The radial channels are in fluid communication with a channel interior the central shaft member. A pair of planar collar members is present, with each collar member fastened to one side of the rotor member. The collar members essentially cover the cylindrical stator member circumferential to the rotor member. The collar members include a plurality of apertures offset from the radial channel outlets of the rotor member. A pair of spacer members is present, with each spacer member sealingly secured between a collar member and the rotor member, the spacer members providing a selected clearance between the collar members and the cylindrical stator member. In operation, a pressurized working fluid, flowing into the central shaft member channel and through the rotor member's radial channels to the channel outlets, impinges on the stator member's stepped surface, thereby imparting rotational movement to the rotor member and attached central shaft. The spent working fluid vents from between the stator member and rotor member via the offset apertures in the collar members and is contained within the shell member. The working fluid preferably is a low boiling point liquid with a high density vapor phase. Examples of such a working fluid include Freon and similar halogenated liquids having a low boiling point, as well as steam (water vapor) or compressed gases, including compressed air.

Figure 2:
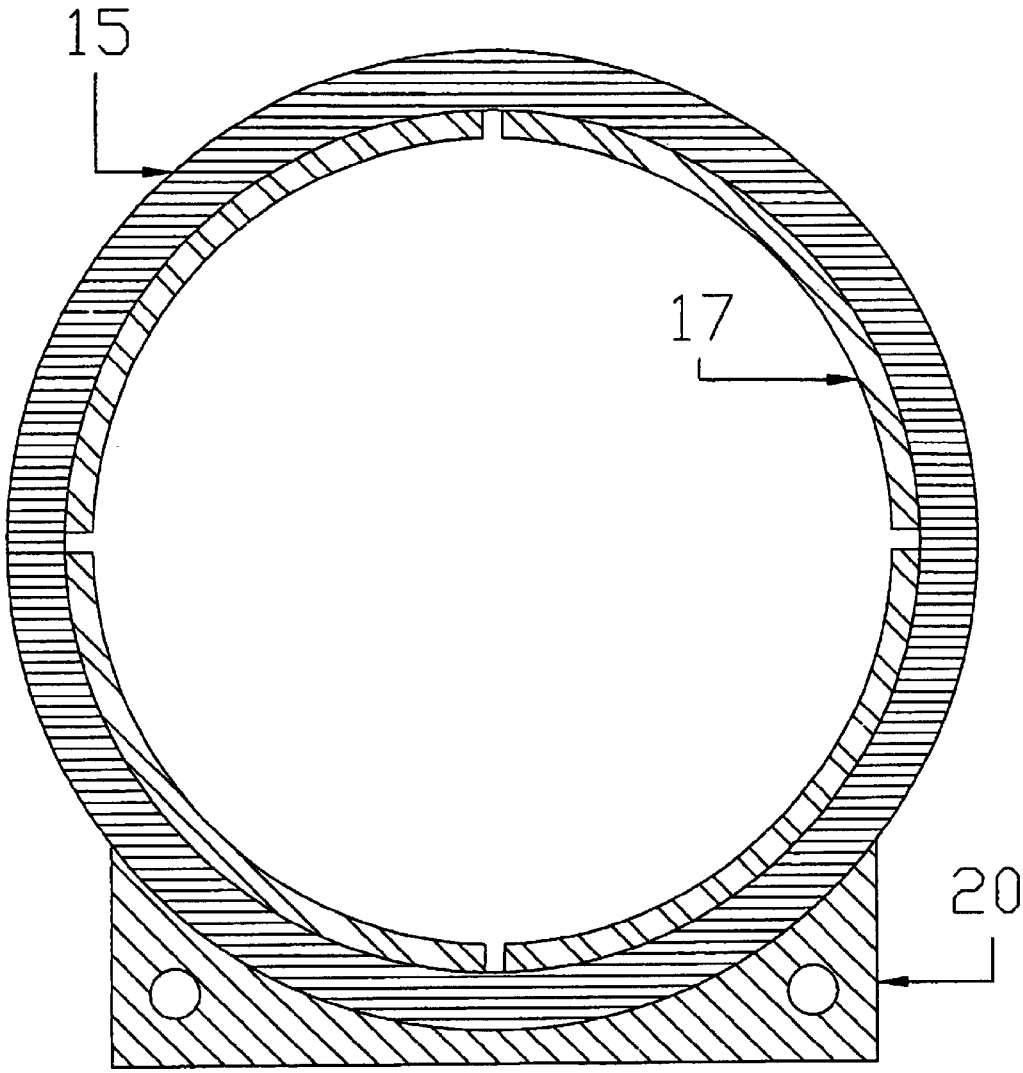
FIG. 2 is a sectional view along line 2–2' of FIG. 1 of the sealable shell member of the present invention.
Figure 3:
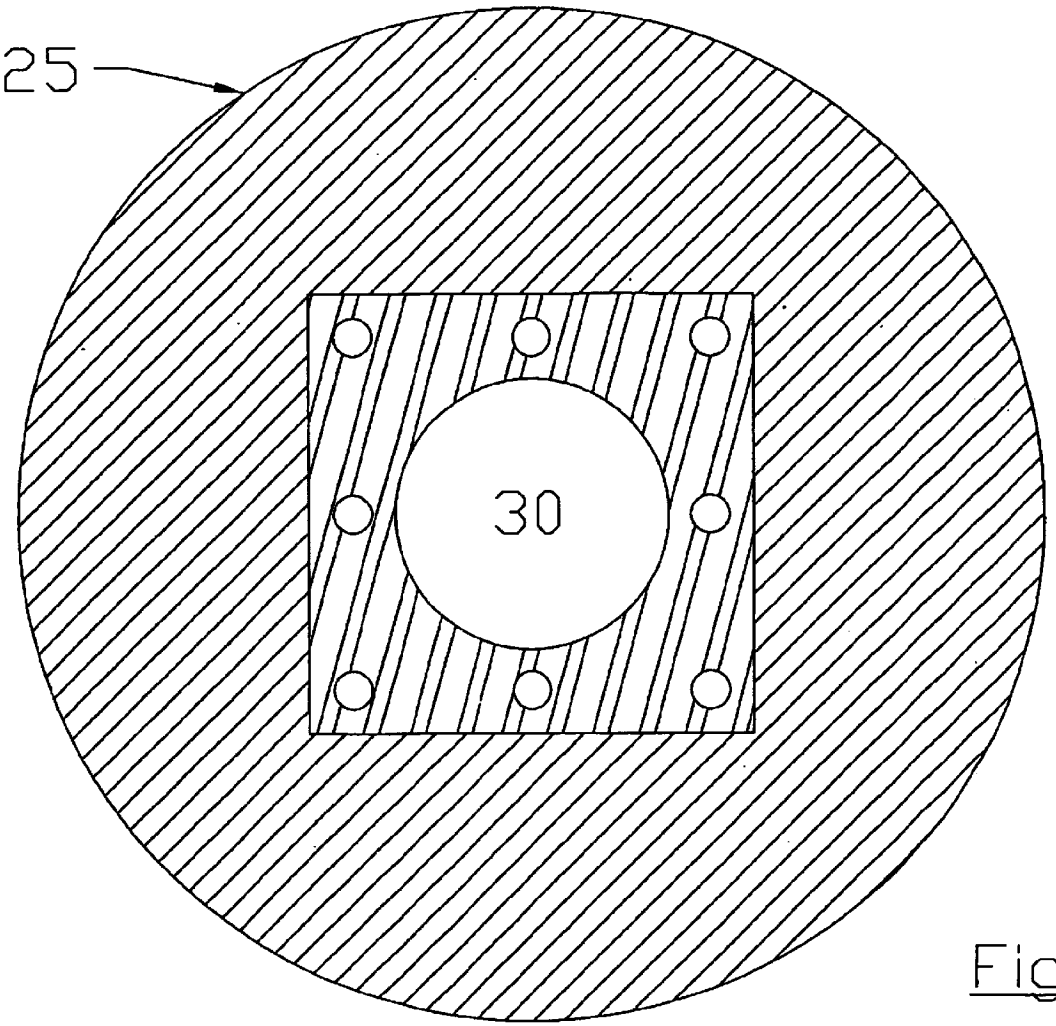
FIG. 3 is an end view of the end cap portion of the shell member of the present invention.
Figure 4:
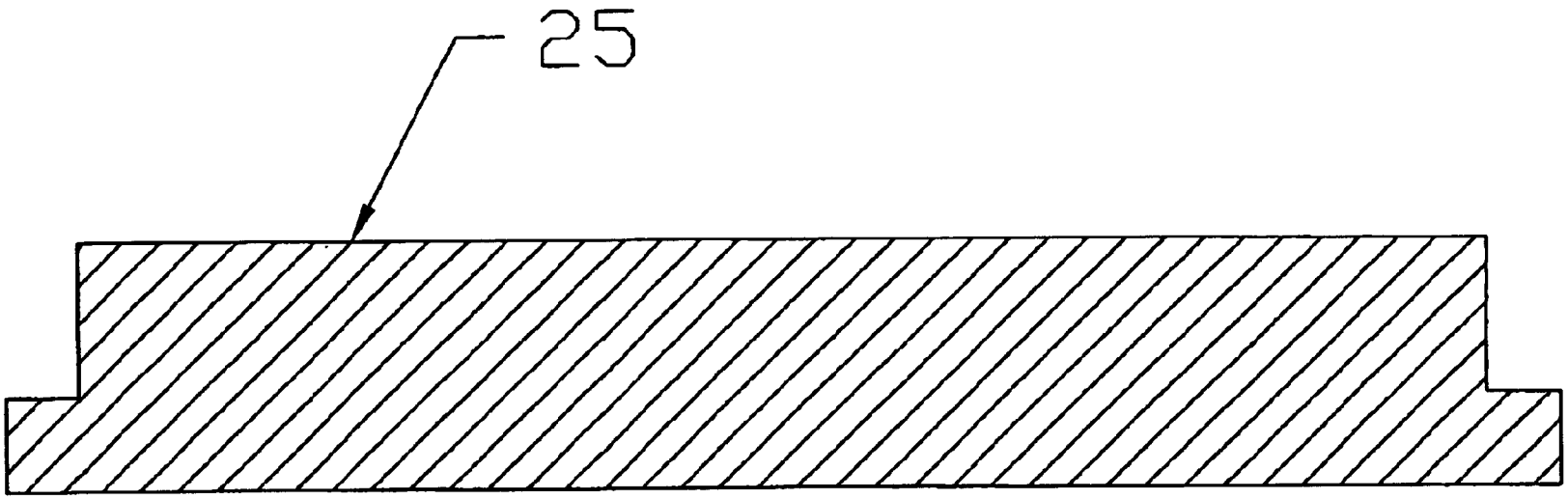
FIG. 4 is a side view of the end cap portion of the shell member of the present invention.

Referring to FIGS. 1–4, several views of the sealable shell member 15 of the rotary expansible chamber device 10 are shown. Preferably the sealable shell member 15 is hollow and cylindrical in shape with a main body portion 17 supported on a base portion 20, as shown in FIGS. 1 and 2. The main body portion 17 includes a plurality of outlet apertures 19 described in detail later. The main body portion 17 of the shell member 15 is sealed at each end by an end cap portion 25, shown in FIGS. 3 and 4. Each end cap portion 25 includes an aperture 30 for mounting a central shaft member 65, also described in detail later. The end cap portions 25 are preferably reversibly secured to the main body portion 17 for assembly of the chamber device 10 and for servicing of the chamber device 10, once assembled. The shell member 15 forms a gas tight chamber with at least one inlet aperture 30 and a plurality of outlet apertures 19.

Figure 5:
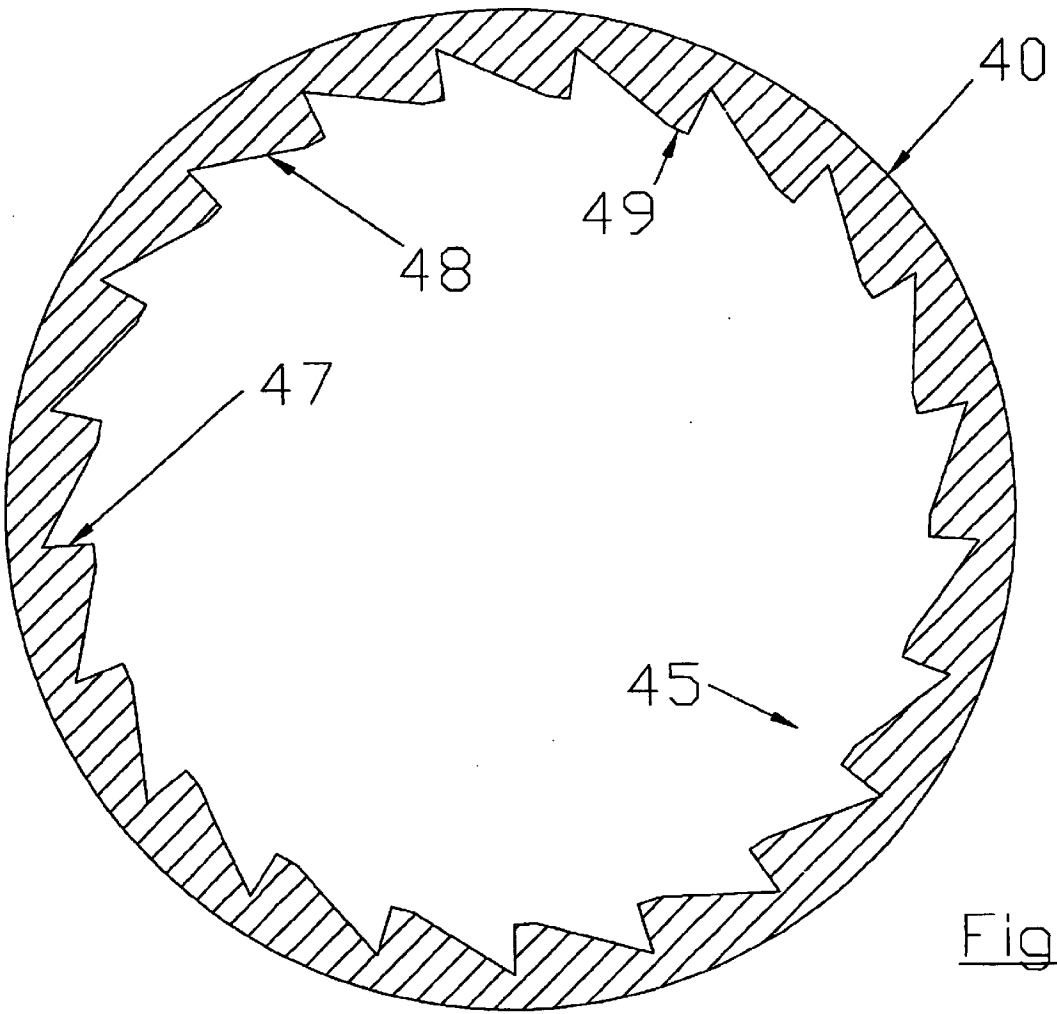
FIG. 5 is an end view of the cylindrical stator member of the present invention.

Referring now to FIG. 5, an end view of the stator member 40 is shown. The stator member 40 is cylindrical and of a selected length, with a continuously stepped interior surface 45. The stator member 40 is rigidly secured interior the shell member 15, for example, by welding or other permanent fastening means. The stator member's stepped, interior surface 45 includes alternating radial sections 47 and non-radial sections 48 that form the stepped surface 45. The intersection of the two sections 47, 48 results in an edge 49 that is preferably blunt.

Figure 6:
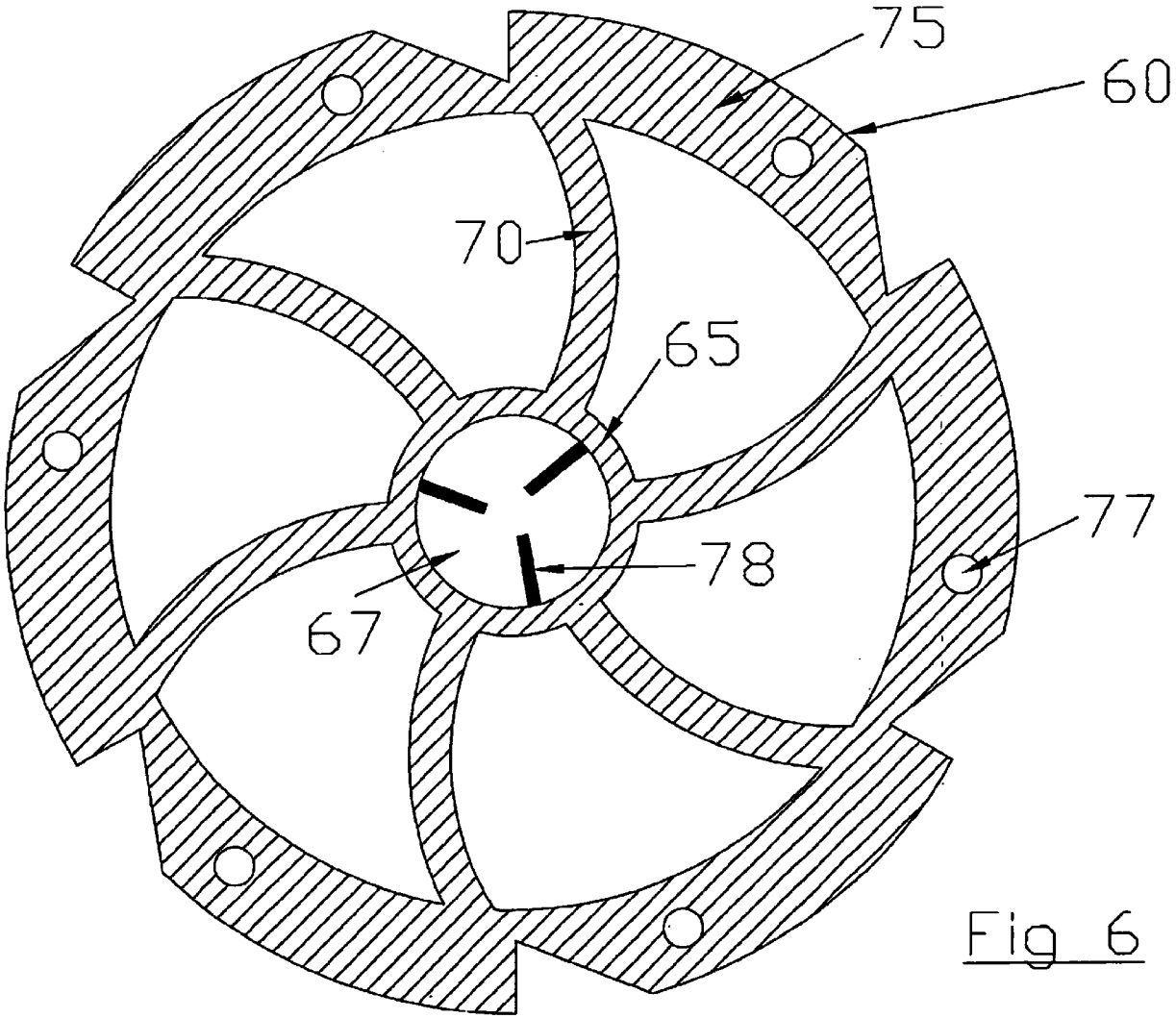
FIG. 6 is an end view of the cylindrical rotor member of the present invention.
Figure 7:
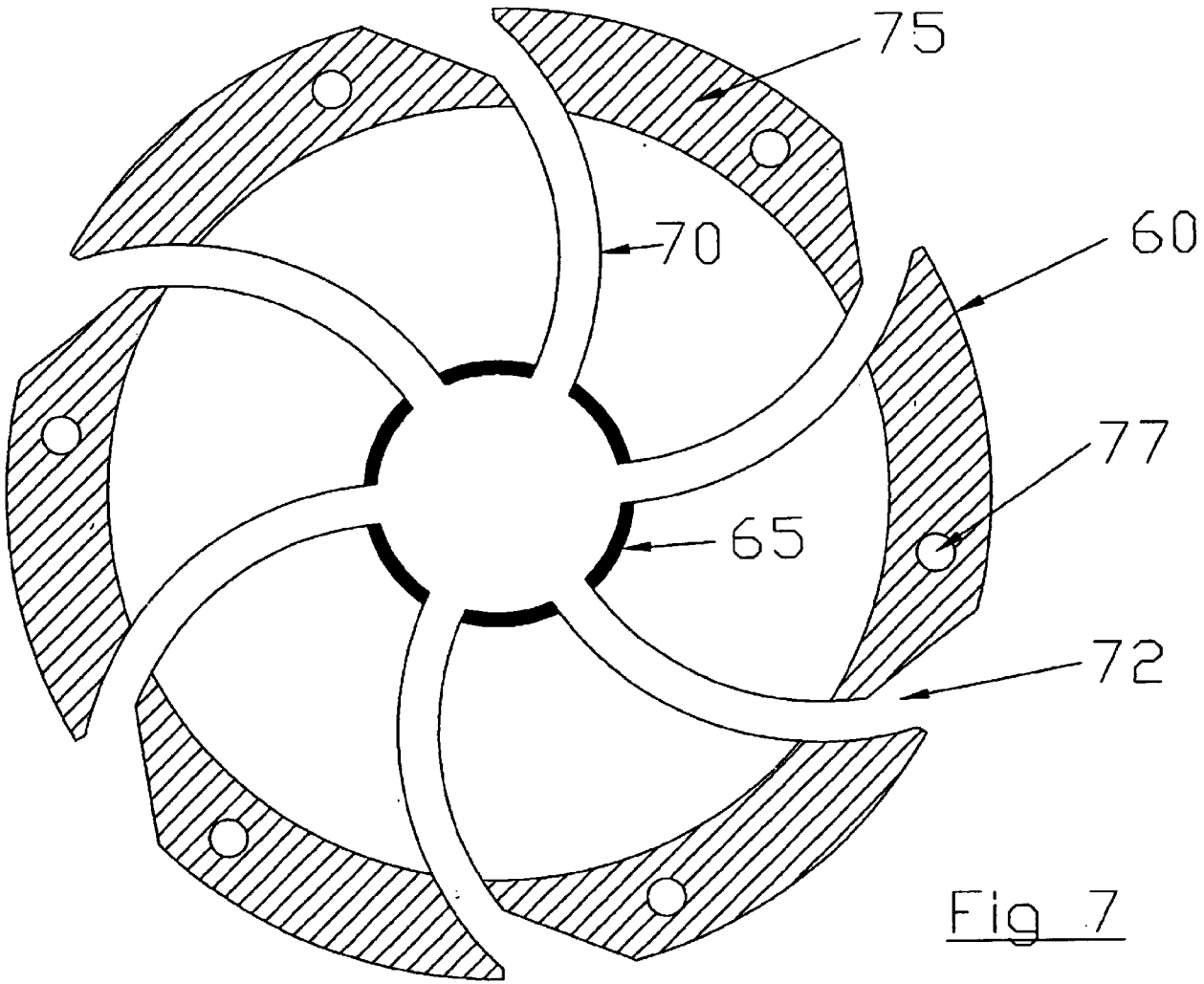
FIG. 7 is a cross sectional view of the cylindrical rotor member of the present invention.
Figure 12:
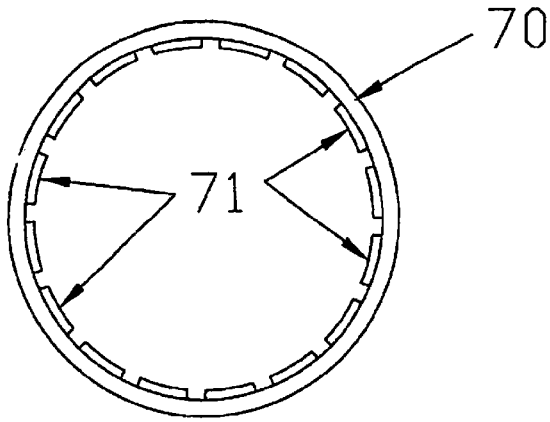
FIG. 12 is a cross sectional view of the radial channel of the rotor member.

Referring now to FIGS. 6 and 7, the cylindrical rotor member 60 is shown. The cylindrical rotor member 60 is of the same length as the stator member 30 and is positioned concentrically, interior the cylindrical stator member 40. The rotor member 60 is fastened to and supported by a central shaft member 65 that is rotatably secured to the shell member 15 by bearing members 95 secured to the two end cap portions 25 thereof. The central shaft member 65 is mounted in an aperture 30 in each end cap portion 25. The rotor member 60 includes a plurality of radial channels 70, for example, tubes or pipes, with outlets 72 at the rotor member's periphery section 75, adjacent the stator member's stepped interior surface 45. The rotor member's periphery section 75 secures the radial channels 70, such as pipes, in a selected pattern discussed in detail below. The peripheral section 75 includes a generally cylindrical surface 63 that faces the stator member 40. The radial channels 70 are in fluid communication with a channel 67 within the central shaft member 65. The channel 67 of the central shaft member 65 is connected to a source of pressurized working fluid exterior the rotary expansible chamber device 10, the channel 67 delivering the working fluid to the rotor member 60. The channel 67 in the central shaft member 65 includes a plurality of pressure guides 78 therein, as shown in FIG. 6. The pressure guides 78 are linear curved members that impart rotary motion to the rotor member 60 as the pressurized working fluid flows through the central shaft channel 67 into the radial channels 70 of the rotor member 60. Preferably, the radial channels 70 of the rotor member 60 extend in an arc from the central shaft member 65. Most preferably, the radial channels 70 each include a nozzle member 74 at the outlet 72 located near the rotor member's periphery section 75. The nozzle member 74 of each radial channel 70 is oriented to deliver the pressurized working fluid directly into the chamber 62 formed between the stator member 40 and the rotor member 60 with overlapping collar members 80. In addition, the radial channels 70 preferably include a spiral pattern of ridges 71 on the channel interior surface, as illustrated in FIG. 12. This feature is referred to as "rifling," which imparts a rotary motion to the pressurized working fluid as the fluid passes through the radial channels 70 into the chambers 62. The rotor member's periphery section 75 includes a plurality of fastener apertures 77 for securing a pair of collar members 80 and spacer m embers 90 thereto.

Figure 8:
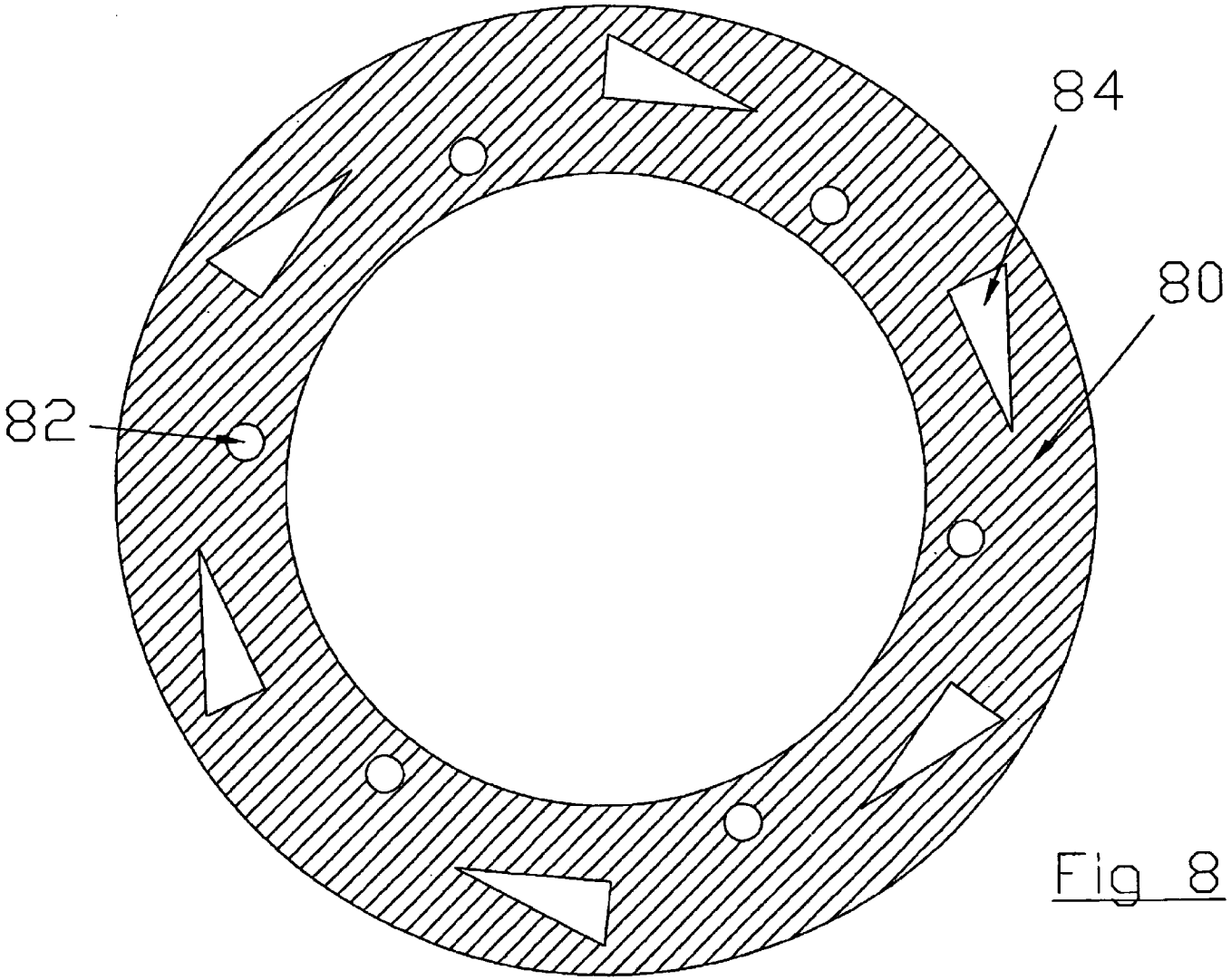
FIG. 8 is an end view of the collar member of the present invention.

Referring now to FIG. 8, a plan view of a collar member 80 is shown. The rotary expansible chamber device 10 includes a pair of planar collar members 80, with each planar collar member 80 fastened to one side of the rotor member 60. The collar members 80 essentially cover the cylindrical stator member 40 circumferential to the rotor member 60, as well as the radial channel outlets 72 of the rotor member 60. The collar members 80 include fastening apertures 82 for securing each collar member 80 to the rotor member 60. The collar members 80 each include a plurality triangular exhaust apertures 84 that are offset from the radial channel outlets 72 of the rotor member 60, when each collar member 80 is secured to the rotor member 60. Preferably, the collar members 80 are identical and secured to the rotor member 60 with the exhaust apertures 84, in register.

Figure 9:
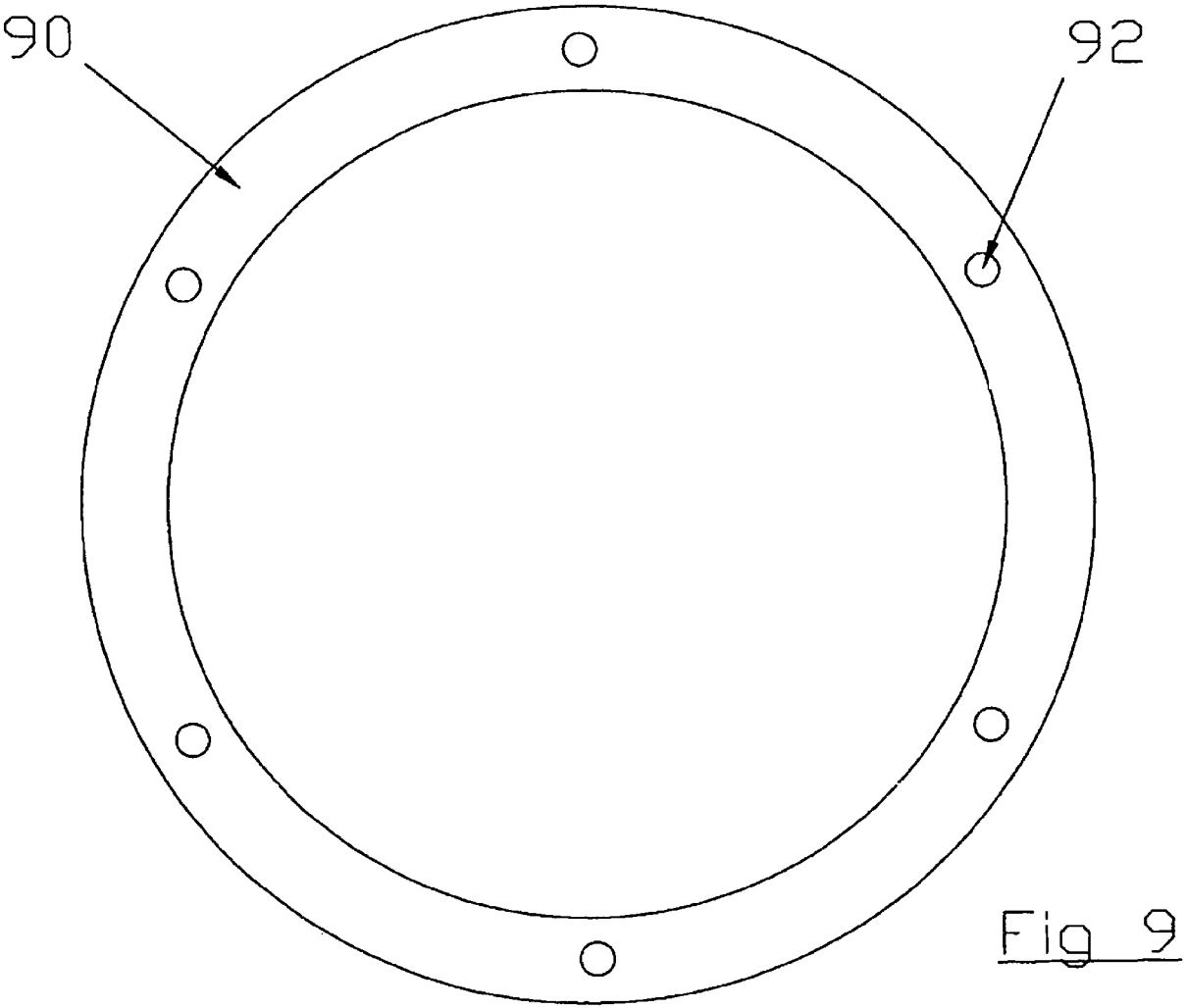
FIG. 9 is a plan view of the spacer member of the present invention.

Also included in the rotary expansible chamber device 10 are a pair of spacer members 90, shown in FIG. 9. Each spacer member 90 is sealingly secured between a collar member 80 and the rotor member 60. Preferably, each spacer member 90 is an annular disk with fastening apertures 92 that coincide with the fastening apertures 82 of the collar member 80 and the fastening apertures 77 of the rotor member 60. The spacer member 90 provides a selected clearance between the collar members 80 and the cylindrical stator member 40.

Figure 13:
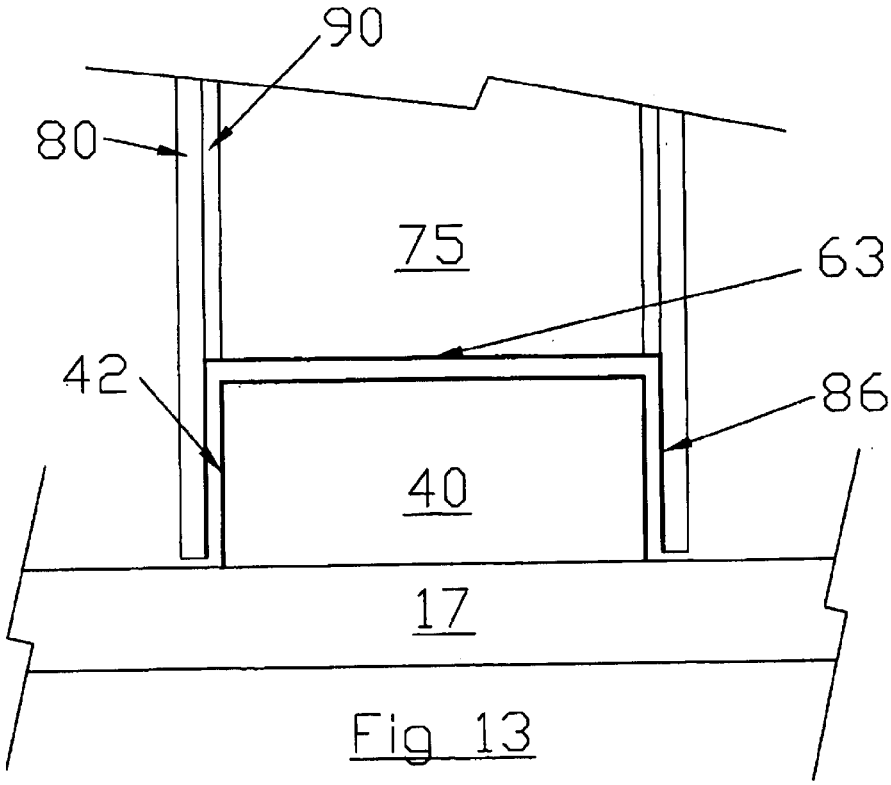
FIG. 13 is a cross sectional view of adjacent surfaces of the stator, rotor, spacer and collar members.

In order to contain the pressurized working fluid within the chambers 62 formed between the stator member 40 and the rotor member 60, a labyrinth seal is established between adjacent elements that move in close proximity to each other. The labyrinth seal is achieved by providing a dimpled surface on adjacent elements that move in close proximity. Thus, the side surface 42 of the stator member 40 and the overlapping collar surface 84, adjacent thereto, are dimpled. Likewise, the radial section 47, the non-radial section 48 and the blunt edge 49 of the stator member 40 are dimpled, as is the cylindrical facing surface 63 of the rotor member 60, thereby providing a labyrinth seal there between. The dimpled surfaces of the adjacent elements are shown in the cross sectional view of FIG. 13.

Figure 10:
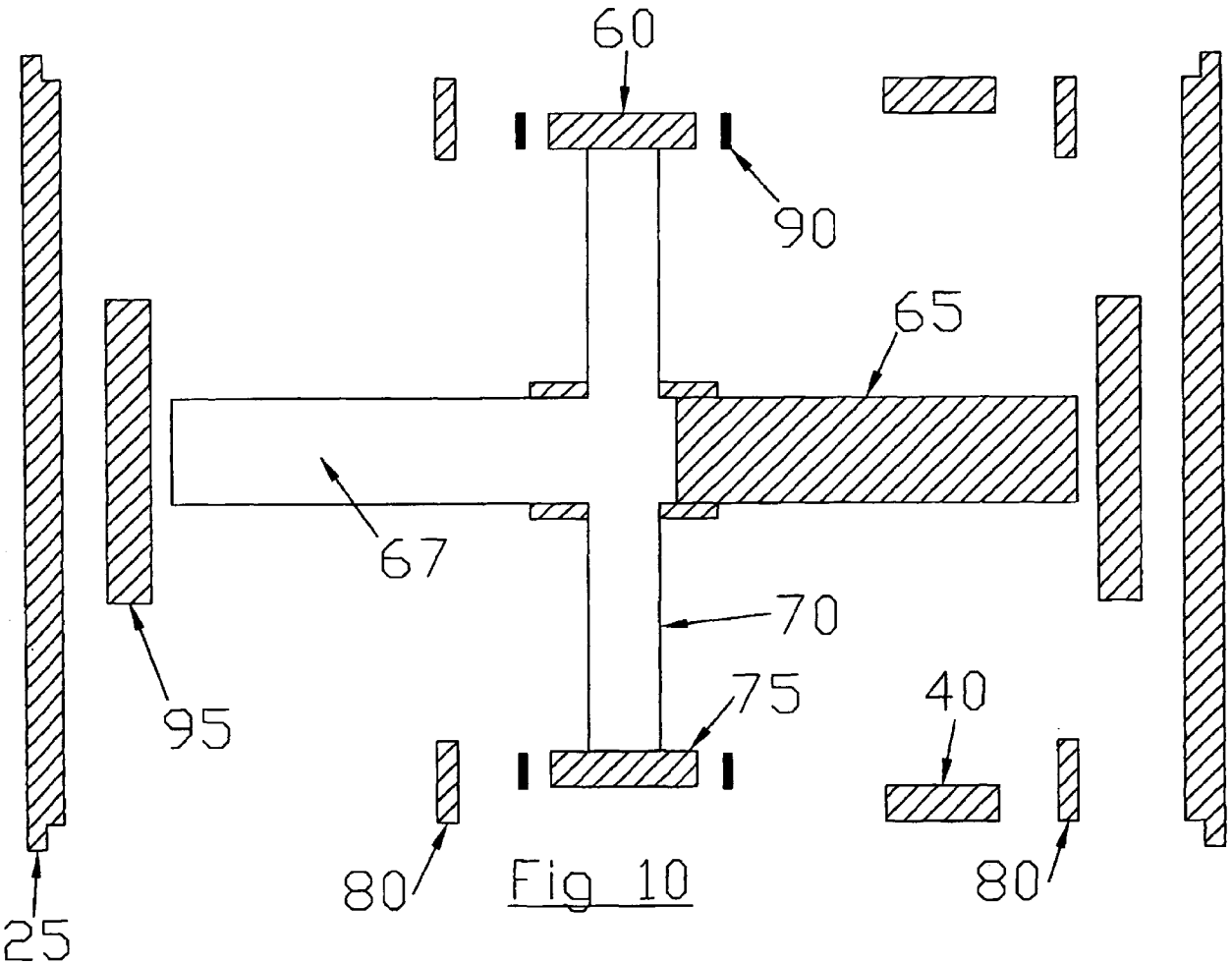
FIG. 10 is an exploded sectional view of the rotary expansible chamber device of the present invention.
Figure 11:
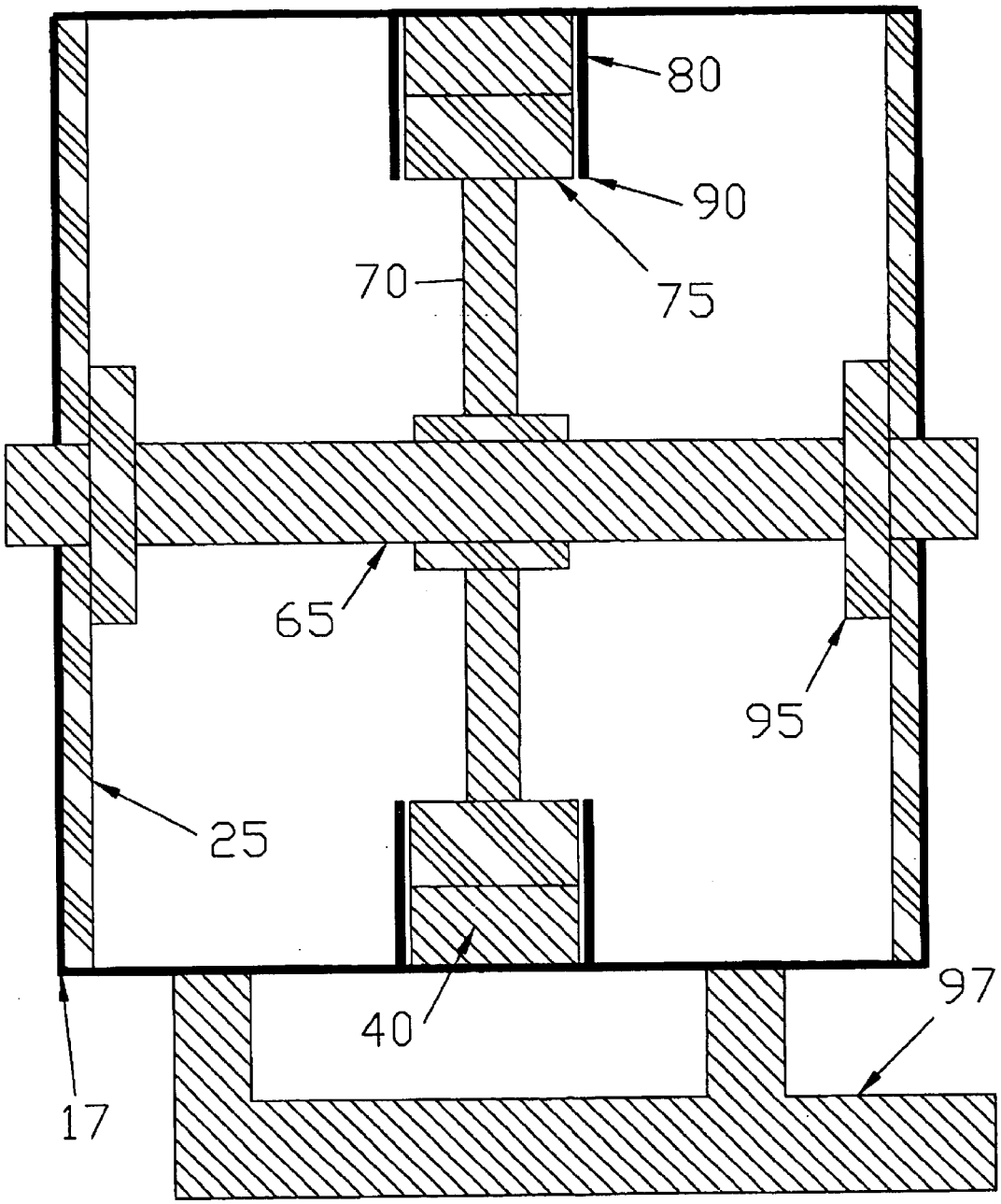
FIG. 11 is a sectional view of the rotary expansible chamber device of the present invention.

Cross sectional views of the rotary expansible chamber device 10 are shown in FIG. 10 and 11. Referring to FIG. 10, an exploded cross sectional view shows the bearings 95 that are sealingly secured to each end cap portion 25 of the shell member 15, the bearings 95 supporting the central shaft member 65 that is connected to the rotor member 60. The central shaft member channel 67 that delivers pressurized working fluid to the radial channels 70 of the rotor member 60 is connected to a working fluid source outside the shell member 15. Referring to FIG. 11, the various elements of the rotary expansible chamber device 10 are shown in their assembled state. The central shaft member 65 extends through both end cap portions 25 of the shell member 15 to provide both an inlet for the pressurized working fluid and a takeoff point for rotational energy produced by the rotary expansible chamber device 10. The spent working fluid is vented from between the stator member 40 and the rotor member 60, via the offset exhaust apertures 84 in the collar members 80, and is retained within the shell member 15. The spent working fluid flows from the shell member 15 via multiple outlet conduits 97 to a suitable energy source for again pressurizing the working fluid.

As mentioned above, the radial channels 70, such as pipes, are secured in a selected pattern by the rotor member's periphery section 75. The radial channels 70 are positioned and secured in a symmetrical pattern around the central shaft member 65 to provide balance as the rotor member 60 rotates during operation. In addition, the stator member's stepped, interior surface 45 contains a selected number of "steps," which produce a similar number of chambers 62 formed between the stator member 40 and the rotor member 60. Preferably, the number of radial channels 70 equals N, and the number of chambers 62 formed between the stator member 40 and the rotor member 60 equals 5N, where N is an integer. It is most preferred that N is an integer greater than 2, such as 3, 4, 5, etc.

To illustrate the operation of the rotary expansible chamber device 10, a timing sequence is presented in FIGS. 14–18. In this illustration, N equals 3, providing three (3) radial channels 70 and corresponding radial channel outlets 72, and fifteen (15) chambers 62, formed between the stator member 40 and the rotor member's periphery section 75. The chambers 62 are designated C-1 through C-15, and the radial channel outlets 72 are designated R-1 through R-3. In the illustration of FIGS. 14–18, the stator member 40, the rotor member's periphery section 75 and one collar member 80 are depicted in a linear, non-circular fashion, with the collar member 80 detached from the rotor member's periphery section 75 for clarity. Each radial channel outlet 72 includes a nozzle 74 for directing the working fluid into the chambers 62.

Figure 14:
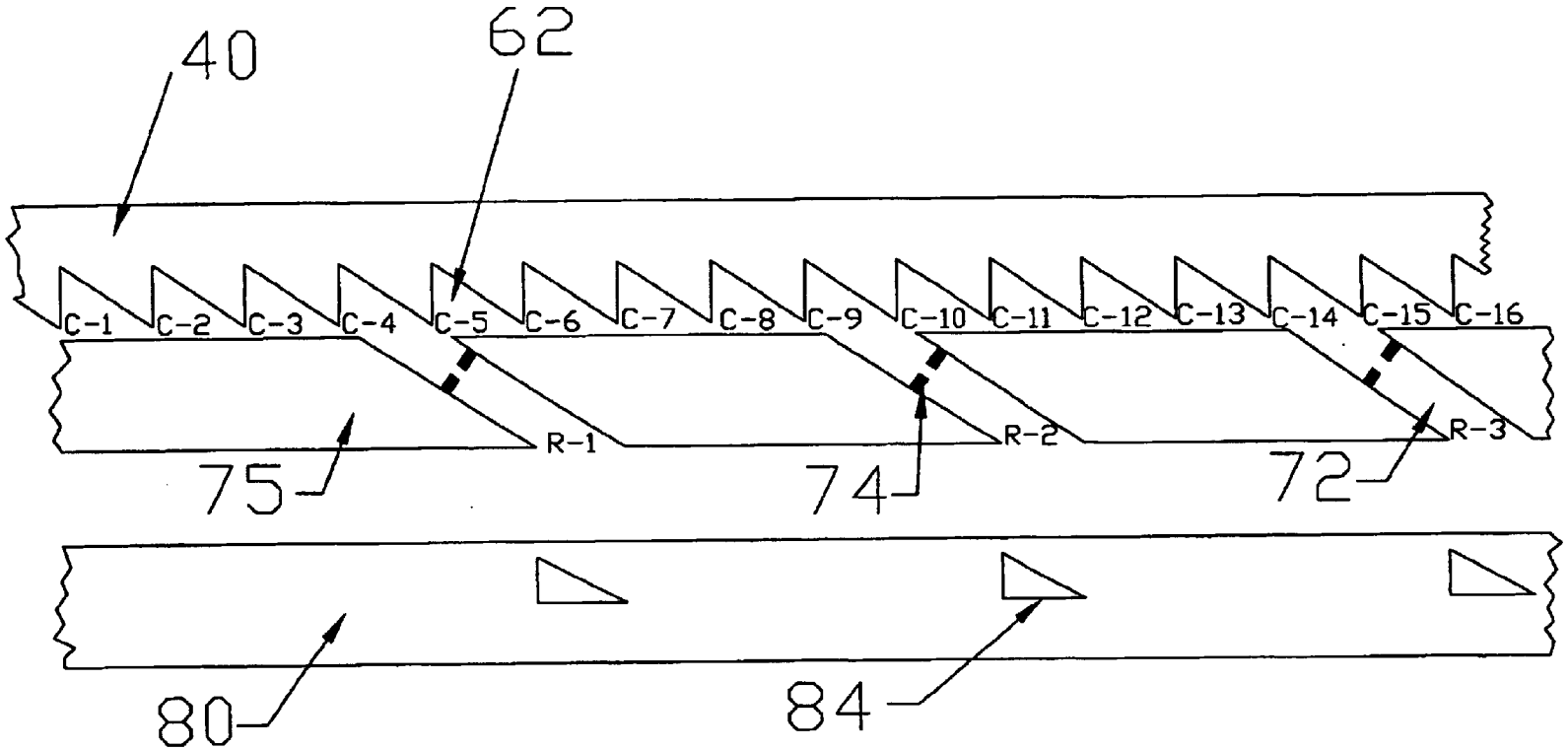
FIG. 14 is a linear depiction of the positioning of the stator member, rotor member, and collar member at time T-1 during operation of the device of the present invention.

At time T-1, FIG. 14, radial channel outlet R-1 is pressurizing chamber C-4, while radial channel outlet R-2 is pressurizing chamber C-9, and radial channel outlet R-3 is pressurizing chamber C-14. As the pressure builds in these chambers 62, the rotor member 60 is forced to move toward the adjacent depressurized chamber located to the right in the figure. The exhaust ports 84 located on the collar members 80, which are secured to the rotor member 60, are aligned with chambers C-1, C-6 and C-11.

Figure 15:
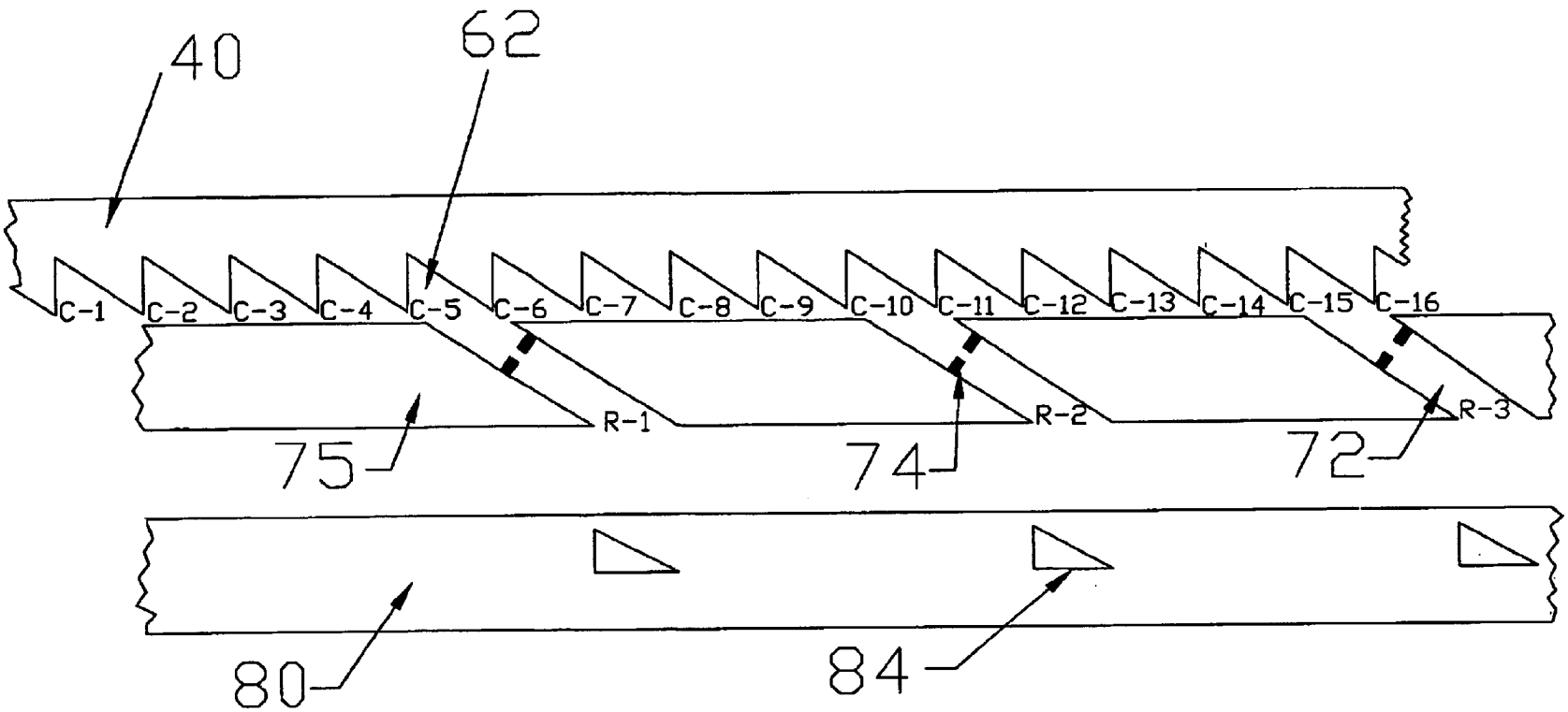
FIG. 15 is a linear depiction of the positioning of the stator member, rotor member, and collar member at time T-2 during operation of the device of the present invention.

At time T-2, FIG. 15, radial channel outlet R-1 is pressurizing chamber C-5, while radial channel outlet R-2 is pressurizing chamber C-10, and radial channel outlet R-3 is pressurizing chamber C-15. As the pressure builds in these chambers 62, it is reinforced by the pressure in chambers C-4, C-9 and C-14, again forcing the rotor member 60 to move toward the adjacent depressurized chamber located to the right in the figure. During this phase, the pressure contained in chambers C-4, C-9 and C-14 is maintained by the labyrinth seals between the collar member 80 and the stator member 40. The exhaust ports 84 located on the collar members 80, which are secured to the rotor member 60, are now aligned with chambers C-2, C-7 and C-12.

Figure 16:
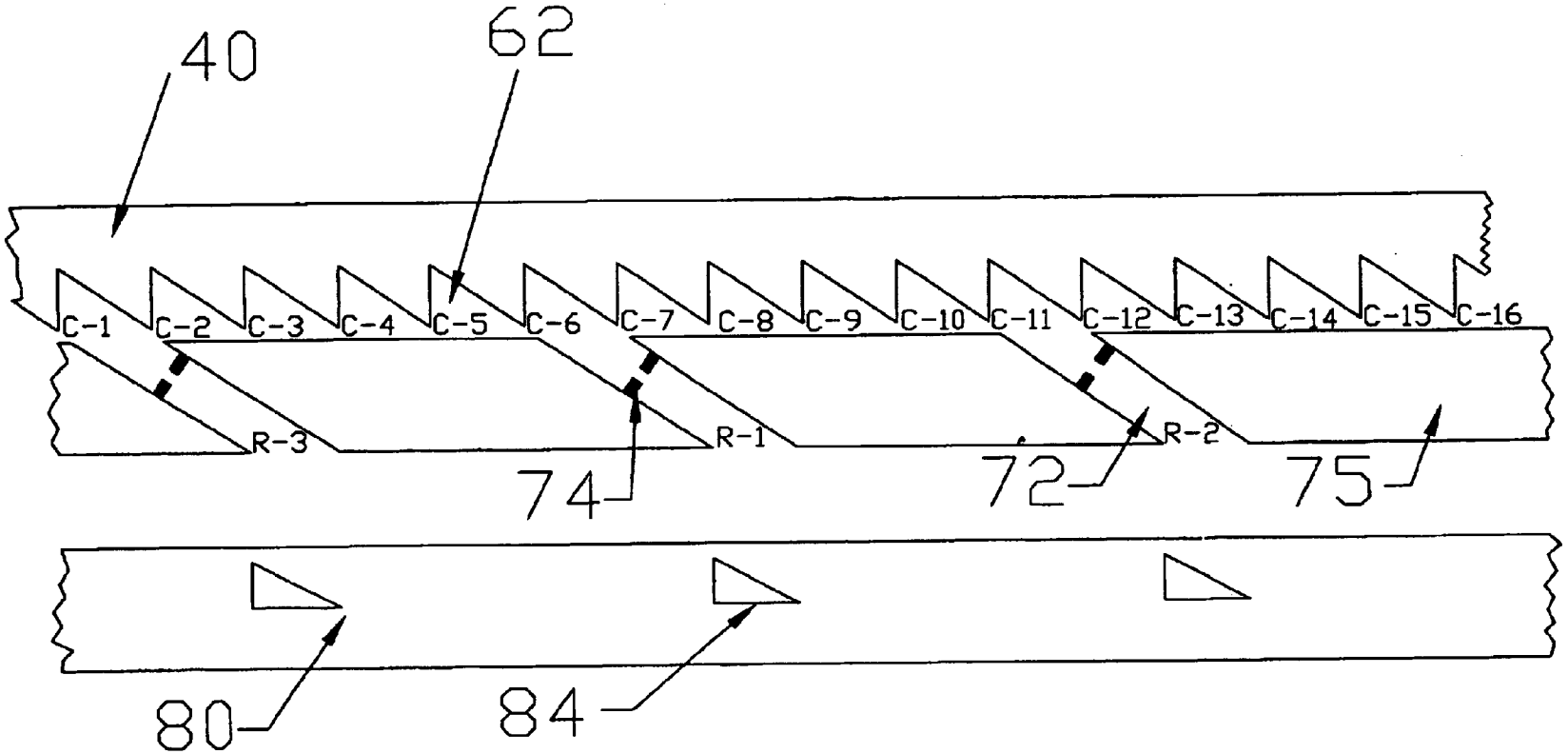
FIG. 16 is a linear depiction of the positioning of the stator member, rotor member, and collar member at time T-3 during operation of the device of the present invention.

At time T-3, FIG. 16, radial channel outlet R-1 is pressurizing chamber C-6, while radial channel outlet R-2 is pressurizing chamber C-11, and radial channel outlet R-3 is pressurizing chamber C-1. As the pressure builds in these chambers 62, it is reinforced by the pressure in chambers C-5, C-10 and C-15, again forcing the rotor member 60 to move toward the adjacent depressurized chamber located to the right in the figure. During this phase, the pressure contained in chambers C-5, C-10 and C-15 is maintained by the labyrinth seals between the collar member 80 and the stator member 40. The exhaust ports 84 located on the collar members 80, which are secured to the rotor member 60, are now aligned with chambers C-3, C-8 and C-13.

Figure 17:
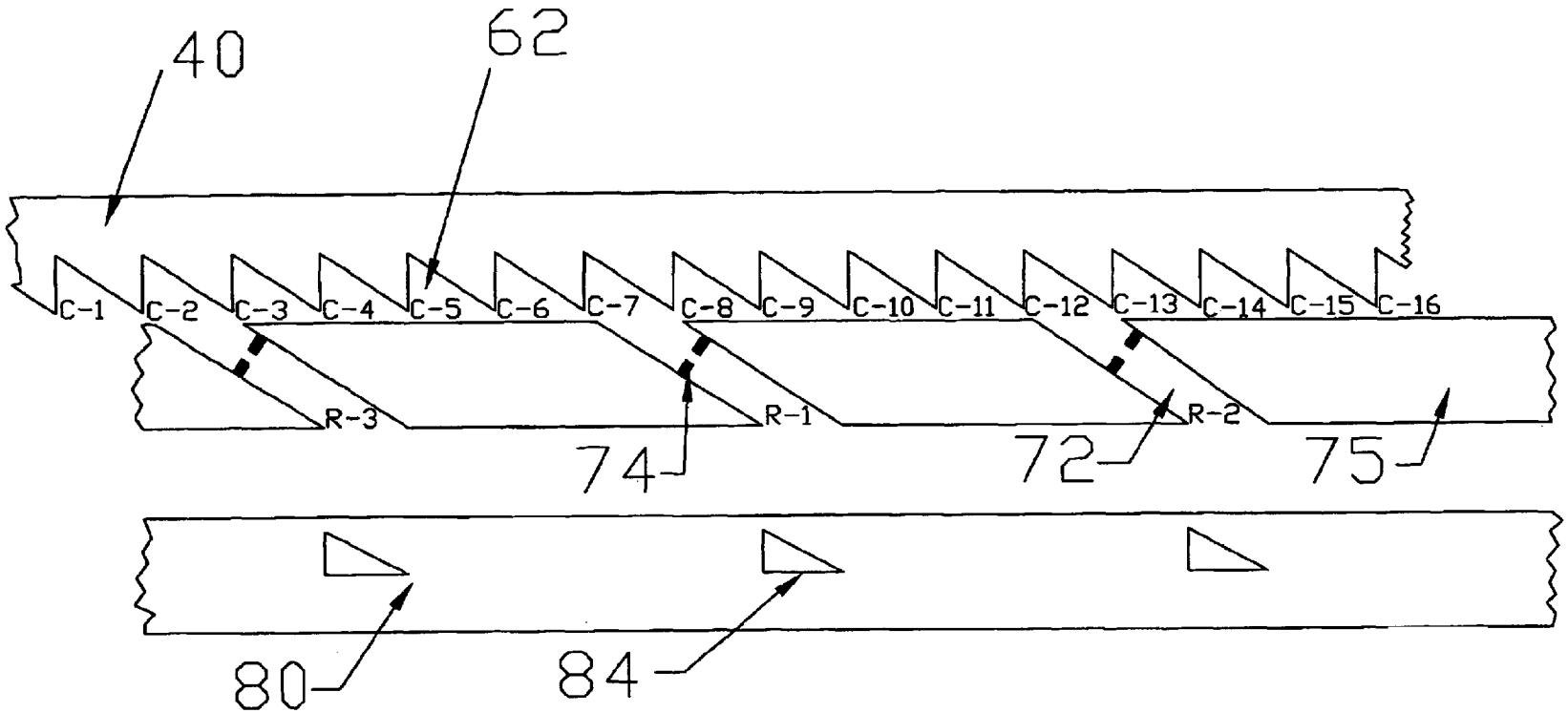
FIG. 17 is a linear depiction of the positioning of the stator member, rotor member, and collar member at time T-4 during operation of the device of the present invention.

At time T-4, FIG. 17, radial channel outlet R-1 is pressurizing chamber C-7, while radial channel outlet R-2 is pressurizing chamber C-12, and radial channel outlet R-3 is pressurizing chamber C-2. As the pressure builds in these chambers 62, it is reinforced by the pressure in chambers C-6, C-11 and C-1, again forcing the rotor member 60 to move toward the adjacent depressurized chamber located to the right in the figure. During this phase, the pressure contained in chambers C-6, C-11 and C-1 is maintained by the labyrinth seals between the collar members 80 and the stator member 40. The exhaust ports 84 located on the collar members 80, which are secured to the rotor member 60, are now aligned with chambers C-4, C-9 and C-14, exhausting the chambers 62 that were pressurized at time T-1.

Figure 18:
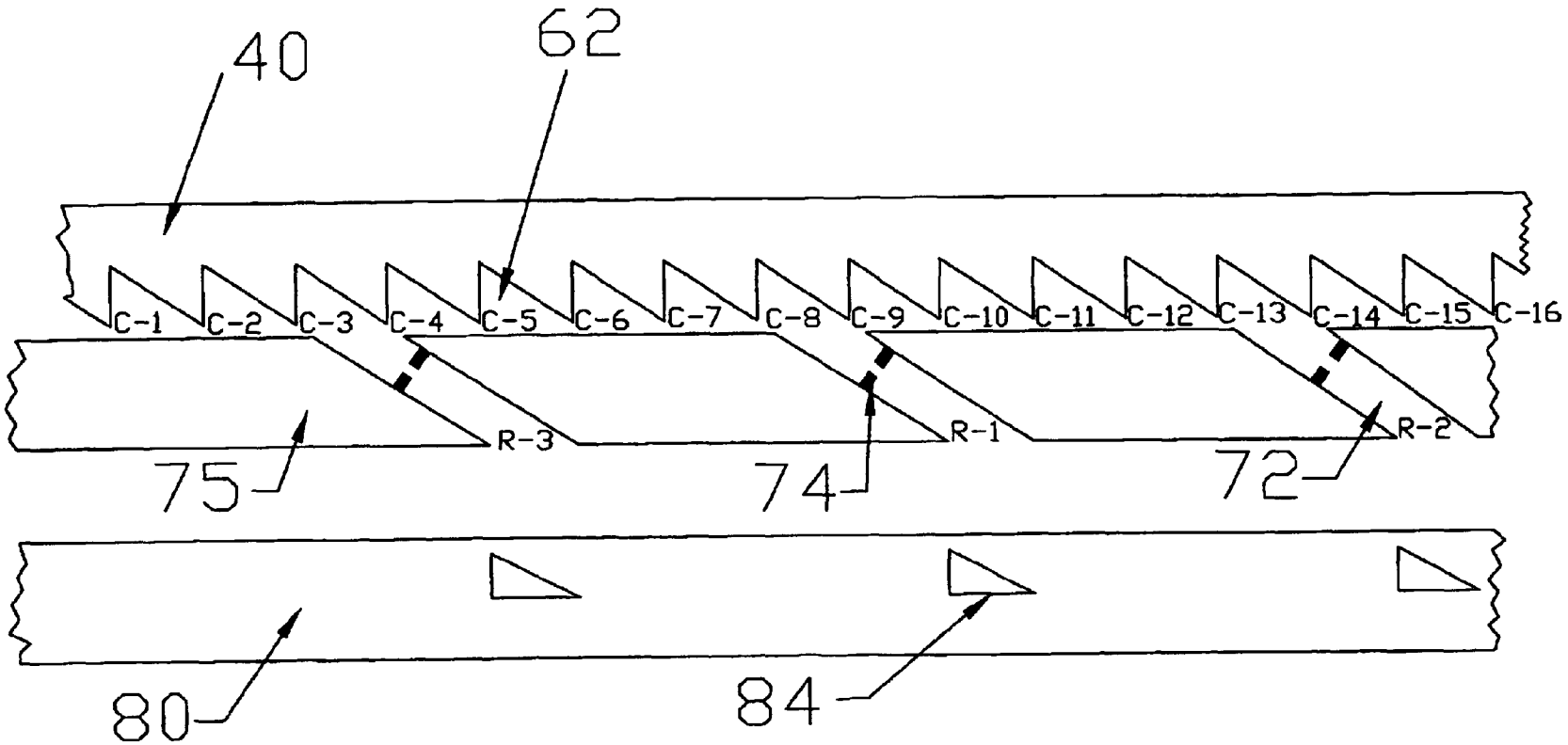
FIG. 18 is a linear depiction of the positioning of the stator member, rotor member, and collar member at time T-5 during operation of the device of the present invention.

At time T-5, FIG. 18, radial channel outlet R-1 is pressurizing chamber C-8, while radial channel outlet R-2 is pressurizing chamber C-13, and radial channel outlet R-3 is pressurizing chamber C-3. As the pressure builds in these chambers 62, it is reinforced by the pressure in chambers C-7, C-12 and C-2, again forcing the rotor member 60 to move toward the adjacent depressurized chamber located to the right in the figure. During this phase, the pressure contained in chambers C-7, C-12 and C-2 is maintained by the labyrinth seals between the collar members 80 and the stator member 40. The exhaust ports 84 located on the collar members 80, which are secured to the rotor member 60, are now aligned with chambers C-5, C-10 and C-15, exhausting the chambers 62 that were pressurized at time T-2.

In this example, at time T-6, all components are in equivalent positions as they were at time T-1, and the sequence is repeated, thereby providing rotation to the rotor member 60 and attached central shaft member 65.

While the invention has been particularly shown and described with reference to preferred embodiments thereof, it will be understood by those skilled in the art that various changes in form and details may be made therein without departing from the spirit and scope of the invention.

I claim:

1. A rotary expansible chamber device comprising:

a sealable shell member with hollow interior;

a cylindrical stator member of a selected length rigidly secured interior the shell member, the stator member having a continuously stepped interior surface;

a cylindrical rotor member of said selected length positioned concentrically interior the cylindrical stator member forming a plurality of chambers with the stator member's continuously stepped interior surface, the rotor member fastened and supported by a central shaft member rotatably secured to the shell member, the rotor member including a plurality of radial channels with outlets at the rotor member's periphery adjacent the stator member's stepped interior surface, the radial channels in fluid communication with a channel interior the central shaft member;

a pair of planar collar members, each collar member fastened to one side of the rotor member, the collar members essentially covering the cylindrical stator member circumferential to the rotor member, the collar members including a plurality of apertures offset from the radial channel outlets of the rotor member; and a pair of spacer members, each spacer member sealingly secured between a collar member and the rotor member, the spacer members providing a selected clearance between the collar members and the cylindrical stator member;

whereby a pressurized working fluid, flowing into the central shaft member's channel and through the rotor member's radial channels to the channel outlets, impinges on the stator member's stepped surface, thereby imparting rotational movement to the rotor member and attached central shaft, the spent working fluid venting from between the stator member and rotor member via the offset apertures in the collar members and contained within the shell member.

2. The rotary expansible chamber device of claim 1, wherein the rotor member's radial channels extend in an arc from the central shaft member.

3. The rotary expansible chamber device of claim 1, wherein the rotor member's radial channels include rifling on an interior surface.

4. The rotary expansible chamber device of claim 1, wherein the rotor member's radial channel outlets include a nozzle member to direct the working fluid exiting therefrom.

5. The rotary expansible chamber device of claim 1, wherein adjacent surfaces of the stator member and the rotor member, and adjacent surfaces of the stator member and the collar members, are dimpled to form a labyrinth seal there between.

6. The rotary expansible chamber device of claim 1, wherein the collar member's offset apertures are triangular and sized to match the chambers formed between the stator member and the rotor member.

7. The rotary expansible chamber device of claim 1, wherein the number of radial channels equals N and the number of chambers formed between the stator member and the rotor member equals 5N, where N is an integer.

8. The rotary expansible chamber device of claim 7, wherein the number N is preferably an integer greater than 2.

9. The rotary expansible chamber device of claim 1, further including a plurality of pressure guides secured to an interior surface of the central shaft member's interior channel.

10. The rotary expansible chamber device of claim 9, wherein the pressure guides are linear, curved members.

11. A rotary expansible chamber device comprising:

a sealable shell member with hollow interior;

a cylindrical stator member of a selected length rigidly secured interior the shell member, the stator member having a continuously stepped interior surface;

a cylindrical rotor member of said selected length positioned concentrically interior the cylindrical stator member forming a plurality of chambers with the stator member's continuously stepped interior surface, the rotor member fastened and supported by a central shaft member rotatably secured to the shell member, the rotor member including a plurality of radial channels with outlets at the rotor member's periphery adjacent the stator member's stepped interior surface, the radial channels in fluid communication with a channel interior the central shaft member;

a pair of planar collar members, each collar member fastened to one side of the rotor member, the collar members essentially covering the cylindrical stator member circumferential to the rotor member, the collar members including a plurality of apertures offset from the radial channel outlets of the rotor member;

a pair of spacer members, each spacer member sealingly secured between a collar member and the rotor member, the spacer members providing a selected clearance between the collar members and the cylindrical stator member; and adjacent surfaces of the stator member and the rotor member, and adjacent surfaces of the stator member and the collar members, are dimpled to form a labyrinth seal there between;

whereby a pressurized working fluid, flowing into the central shaft member's channel and through the rotor member's radial channels to the channel outlets, impinges on the stator member's stepped surface, thereby imparting rotational movement to the rotor member and attached central shaft, the spent working fluid venting from between the stator member and rotor member via the offset apertures in the collar members and contained within the shell member.

12. The rotary expansible chamber device of claim 11, wherein the rotor member's radial channels extend in an arc from the central shaft member.

13. The rotary expansible chamber device of claim 11, wherein the rotor member's radial channels include rifling on an interior surface.

14. The rotary expansible chamber device of claim 11, wherein the rotor member's radial channel outlets include a nozzle member to direct the working fluid exiting therefrom.

15. The rotary expansible chamber device of claim 11, wherein the collar member's offset apertures are triangular and sized to match the chambers formed between the stator member and the rotor member.

16. The rotary expansible chamber device of claim 11, wherein the number of radial channels equals N and the number of chambers formed between the stator member and the rotor member equals 5N, where N is an integer.

17. The rotary expansible chamber device of claim 16, wherein the number N is preferably an integer greater than 2.

18. The rotary expansible chamber device of claim 11, further including a plurality of pressure guides secured to an interior surface of the central shaft member's interior channel.

19. The rotary expansible chamber device of claim 18, wherein the pressure guides are linear, curved members.

20. A rotary expansible chamber device comprising:

a sealable shell member with hollow interior;

a cylindrical stator member of a selected length rigidly secured interior the shell member, the stator member having a continuously stepped interior surface;

a cylindrical rotor member of said selected length positioned concentrically interior the cylindrical stator member forming a plurality of chambers with the stator member's continuously stepped interior surface, the rotor member fastened and supported by a central shaft member rotatably secured to the shell member, the rotor member including a plurality of radial channels with outlets at the rotor member's periphery adjacent the stator member's stepped interior surface, the radial channels in fluid communication with a channel interior the central shaft member, the radial channels extending in an arc from the central shaft member, the number of radial channels equals N and the number of chambers formed between the stator member and the rotor member equals 5N, where N is an integer;

a pair of planar collar members, each collar member fastened to one side of the rotor member, the collar members essentially covering the cylindrical stator member circumferential to the rotor member, the collar members including a plurality of apertures offset from the radial channel outlets of the rotor member;

a pair of spacer members, each spacer member sealingly secured between a collar member and the rotor member, the spacer members providing a selected clearance between the collar members and the cylindrical stator member; and adjacent surfaces of the stator member and the rotor member, and adjacent surfaces of the stator member and the collar members, are dimpled to form a labyrinth seal there between;

whereby a pressurized working fluid, flowing into the central shaft member's channel and through the rotor member's radial channels to the channel outlets, impinges on the stator member's stepped surface, thereby imparting rotational movement to the rotor member and attached central shaft, the spent working fluid venting from between the stator member and rotor member via the offset apertures in the collar members and contained within the shell member.

* * * * *